US005301377A

United States Patent [19]

Kim

[11] Patent Number: 5,301,377

[45] Date of Patent: Apr. 12, 1994

[54] PORTABLE COT

[76] Inventor: Samuel B. Kim, 17221 Balfern Ave., Bellflower, Calif. 90706

[21] Appl. No.: 93,482

[22] Filed: Jul. 19, 1993

[51] Int. Cl.[5] ..... A47C 17/64

[52] U.S. Cl. ..... 5/110; 5/111; 5/114

[58] Field of Search ..... 5/110-112, 5/114

[56] References Cited

U.S. PATENT DOCUMENTS 3,965,502 6/1976 Bertram ..... 5/111
4,219,896 9/1980 Behel ..... 5/114

FOREIGN PATENT DOCUMENTS 205110 3/1955 Australia ..... 5/110
516670 9/1955 Canada ..... 5/111
509363 7/1939 United Kingdom ..... 5/112
2142232 1/1985 United Kingdom ..... 5/110

*Primary Examiner*—Michael F. Trettel
*Attorney, Agent, or Firm*—Edgar W. Averill, Jr.

[57] ABSTRACT

A portable cot which is light in weight, may be disassembled into a compact package but which forms a firm sleeping surface when assembled. The cot has a generally rectangular canvas surface with an elongated pocket along each side. Side rails are held in each of the pockets and three leg assemblies are affixed to the side rails by wire U-shaped legs pivotally attached to the bottom to a base bar and at the top to the side rails. Adjustable straps tighten the side rails against the legs and form a firm assembly with the base bars. The straps may be adjusted so that the bed can be made level even against a slanted surface.

12 Claims, 3 Drawing Sheets

PORTABLE COT

BACKGROUND OF THE INVENTION

The field of the disclosure is camping equipment and the invention relates more particularly to cots which may be disassembled into a small light weight package.

Portable cots have been known for many years. Some have hinged bars along the sides and leg members hingedly affixed to the side rails. More recently, cots have been made from aluminum tubing which is light in weight and have legs which are hingedly or which are tubular and inserted into tubular sockets riveted or otherwise affixed to the side rail. Examples of such cots are shown in U.S. Pat. Nos. 3,965,502 and 4,219,896 and also in a catalogue described as follows: "The Magical Spare Bed," U.S. News & World Report, Nov. 30, 1992.

Most of the portable cots heretofore are used have either been heavy, expensive to fabricate, difficult to assemble, and permit a small amount of longitudinal or sideways motion so that the user is insecure in the user's use of the cot.

SUMMARY OF THE INVENTION

It is an object of the present invention to provide a portable cot which may be held in a disassembled condition in a compact package but which may be assembled into a firm sleeping surface.

The present invention is for a portable cot having a generally rectangular canvas surface having right and left side elongated pockets which contain right and left side rails. Three sets of leg assemblies are held to the side rails by three pairs of leg members which are fabricated from a generally U-shaped length of wire. The wire is pivotally connected to a base bar at the bottom end and the two upper ends are inserted into holes in the side rails. The legs are angled outwardly from the base bar to their point of connection with the side rails, preferably at about a 45° angle between the legs and base bar. The side rails are also connected to the base bars by three pairs of adjustable straps which may be tightened to create a very secure sleeping surface. Preferably, the side rails may be split into two sections when the cot is disassembled.

DESCRIPTION OF THE PREFERRED EMBODIMENTS

Figures 1, 2:
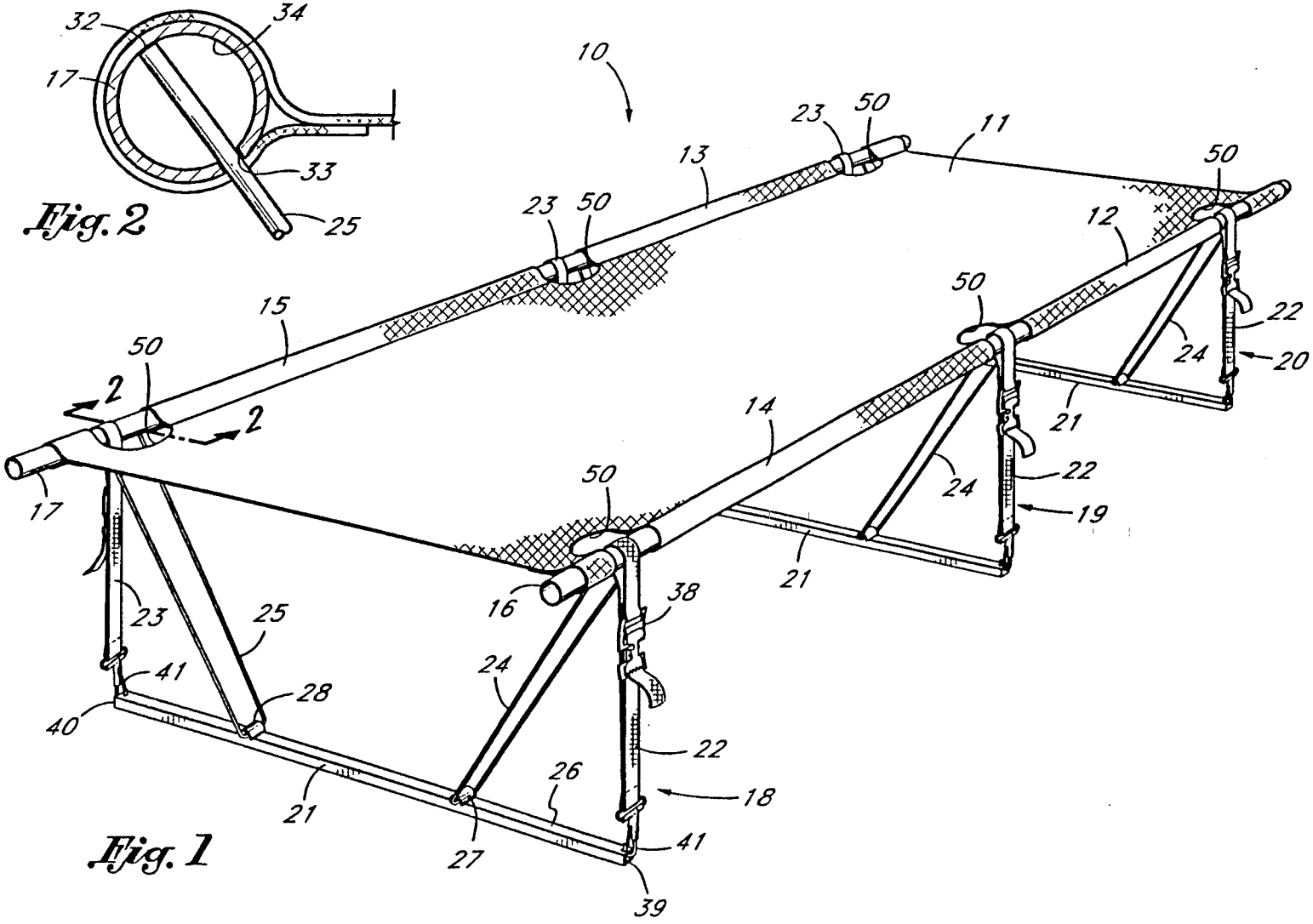
FIG. 1 is a perspective view of the portable cot of the present invention.
FIG. 2 is a cross-sectional view taken along line 2—2 of FIG. 1

The portable cot of the present invention in shown in perspective view in FIG. 1 and indicated by reference character 10. Portable cot 10 has a canvas surface member 11 which is generally rectangular in shape, having a right edge 12 and a left edge 13. A right elongated pocket 14 and a left elongated pocket 15 hold a right elongated side tube 16 and a left elongated side tube 17 respectively. Three pairs of leg assemblies are indicated by reference characters 18, 19 and 20. Each leg assembly has a base bar 21, a right adjustable strap 22, and a left adjustable strap 23. Each leg assembly also has a pair of leg members comprising a right leg member 24 and a left leg member 25. Each leg member is held to the top surface 26 of base bar 21 which is fabricated from a length of square tubing. A metal strap 27 holds the right leg member and a metal strap 28 the left leg member to top surface 26 of base bar 21. As shown best in FIG. 3, each leg member has a pair of upper termini, right leg member having termini 29 and 30 and left leg member having upper termini 31 and 32. These termini are inserted into holes such as hole 33, shown in FIG. 2 into which the upper terminus 32 is inserted and abuts the inner surface 34 of left elongated side tube 17. Similarly, upper terminus 31 fits into hole 35 inside tube 17. Upper termini 29 and 30 fit into holes 36 and 37 in an elongated right side tube 16.

Each strap is adjustable in length and a clamp 38 is present in each of the adjustable straps. It would, of course, be possible to provide a cot where the straps along one side are not adjustable and only the straps on the other side are adjustable. This is not, however, preferred since it does not permit the leveling feature illustrated by the comparison FIGS. 4 and 5 discussed below.

Figure 3:
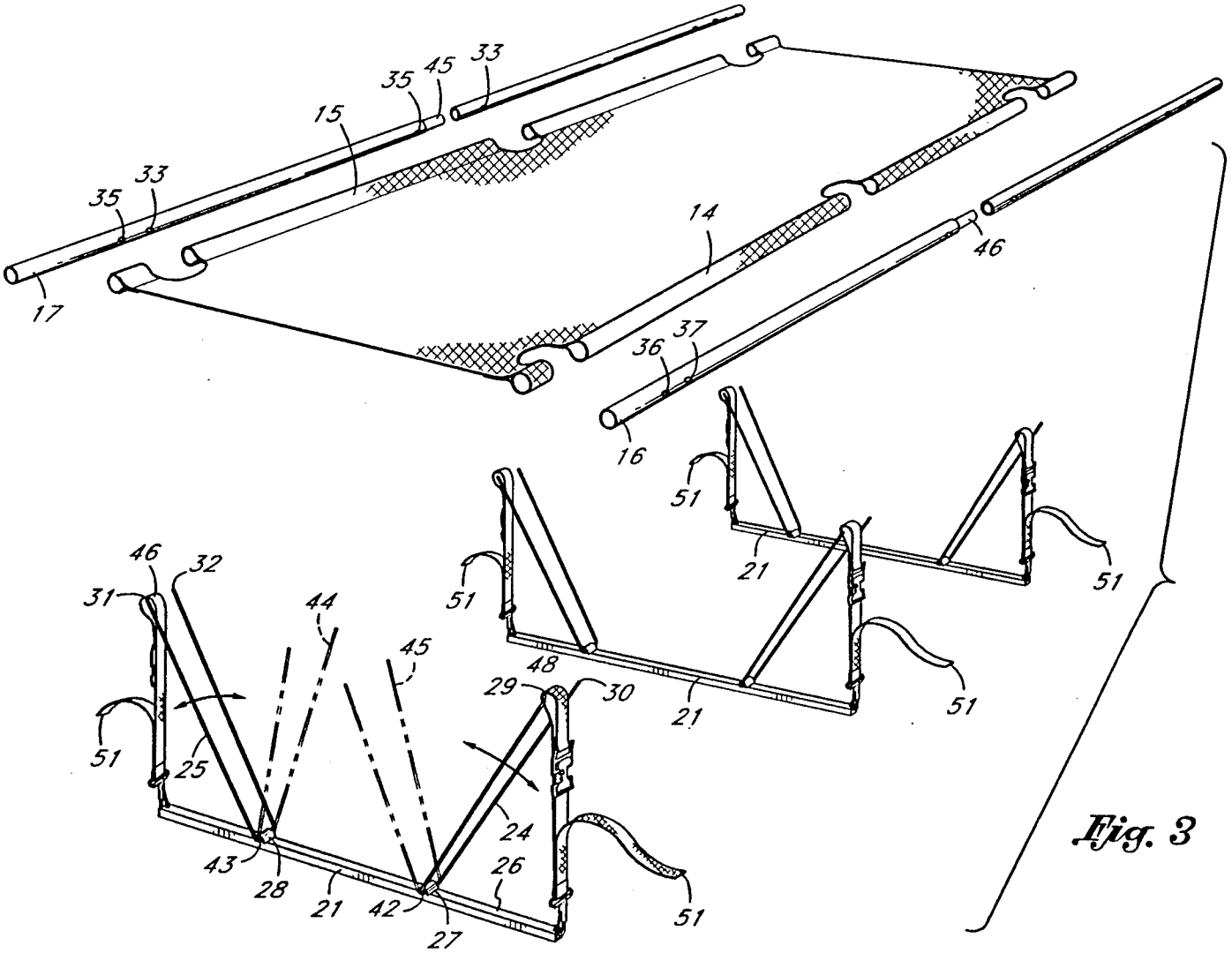
FIG. 3 is an exploded perspective view of the portable cot of FIG. 1.

As shown in FIG. 3 the clamp 38 of the straps is passed upwardly through opening 50 in canvas surface member 11. The free ends 51 are passed into the clamps 38 and tightened. The lower end of each strap is held to either the right end 39 or the left end 40 of base bar 21 by a clip 41. The base bar 21 is made to a length so that the straps are about vertical when the cot is assembled.

Turning now to the assembly of the cot, the pieces of the cot are shown best in FIG. 3 where it can be seen that the leg members 24 and 25 are formed from a wire into a U-shape with the lower base 42 of leg 24 being pivotally held against the top surface 26 by strap 27. Similarly, the lower base 43 of leg 25 is held against top surface 26 by metal strap 28. This permits the legs to be pivoted inwardly as indicated by phantom lines 44 and 45 in FIG. 3 so that the base bar 21 and legs 24 and 25 may be folded into a relatively small and compact length.

Figure 4:
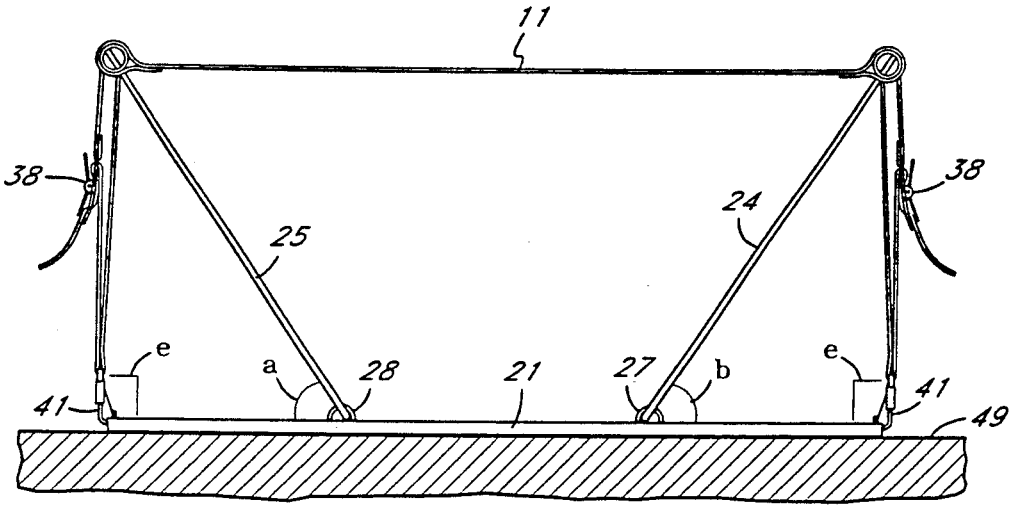
FIG. 4 is an end view of the assembled portable cot of FIG. 1 on a horizontal surface.
Figure 5:
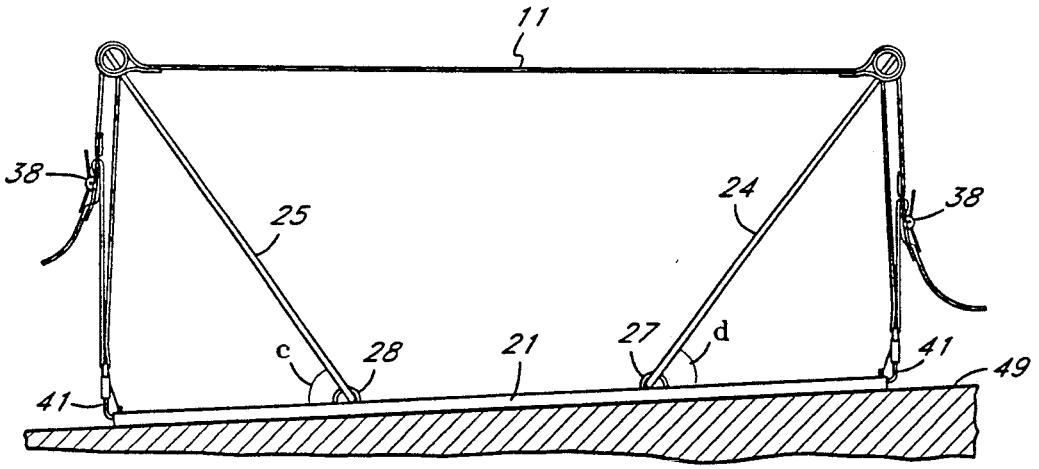
FIG. 5 is an end view of the portable cot of FIG. 1 on a slanted surface.

To assemble the cot, the side tubes 16 and 17 are inserted into the elongated pockets 14 and 15 respectively. Preferably side tubes 16 and 17 may be separated into two lengths and joined by a smaller tapered section 46 and 47 in a conventional manner. When the side tubes are inserted into the elongated pockets, they are placed through the loops 48 at the upper ends of each straps. Next, the upper termini 31 and 32 are inserted into holes 35 and 33 and the upper ends 29 and 30 of leg 24 are inserted into holes 36 and 37. This is done for all three pairs of legs. The clip 41 at the end of each strap is inserted into a hole at each end of each base bar. As a last step, the adjustable straps are tightened. As shown in FIGS. 4 and 5, this tightening may be adjusted so that the bed canvas member 11 may be horizontal even though the ground surface 49 is not horizontal. Note that the canvas surface 11 in FIG. 5 is horizontal even through the ground surface 49 is slanted.

The assembly of the present invention provides a very secure support to the user. This is because the legs form an angle of about 45° with respect to the base. The leg, base and strap, form about an equilateral right triangle in FIG. 4 where angles "a" and "b" are both about 45° and angles "e" are about 90 degrees. Even when the bed is adjusted for non-level surface shown in FIG. 5, angles "c" and "d" are close enough to 45° provide a very stable structure. Furthermore, as shown in FIGS. 4 and 5, the edges of the bed including the legs and base do not protrude outwardly from the bed, and do not provide any sort of safety hazard.

While the drawings depict the bed with three leg assemblies, it is also, of course, contemplated that there be two, four, or more leg assemblies depending upon the object to be supported. While the upper ends of the legs are preferably supported in the side tubes as shown in FIG. 2, they could, of course, alternatively be placed into sleeves welded, or otherwise affixed to the side tubes. An important feature of the present invention is that the upper termini such as 31 and 32 are wider apart then the base. This causes the legs to prevent any longitudinal movement of canvas surface 11 which would be present if they were exactly parallel. This angle need not be great, but is preferably about 5° to 10° from the vertical when the leg is in a vertical position. It has been found that the leg should be fabricated from wire having a diameter about one quarter of an inch and a strap having a width of about one inch has been found sufficiently strong. While the straps are shown looped as a loop 48 around the elongated side tubes, they could, of course, be attached to the side tubes in another manner. While the base bars are shown as square tubing, they could be T-shaped or other shaped and lower base 42 and 43 may be affixed to the bars by means other than the metal straps shown.

In summary, the cot of the present invention is light weight, secure, easily assembled and disassembled. It does not provide any significant safety hazards.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A portable cot which is light in weight and may be disassembled and contained in a small package, said cot comprising:

a generally rectangular canvas surface member having right and left elongated pockets along the right and left edges of the surface member;

right and left elongated side tubes held in said right and left elongated pockets of said canvas surface member;

at least two pairs of leg members, each pair of leg members having a right leg member and a left leg member, each leg member being formed from a wire bent into a generally "U"-shape having a pair of upper termini and a lower base, said "U"-shape being wider at the upper termini than at the lower base, each pair of said leg members being pivotally connected at its base to a single base bar and the lower base of each leg member of each of said pair of leg members is not as wide as the distance separating the upper termini of each pair of leg members and the upper termini of each right and left leg members being affixable to the right and left elongated side tubes respectively;

at least two base bars which rest on a floor when the cot is assembled, each base bar being normal to the side tubes when the cot is assembled and each bar having a right end and a left end and a pair of said leg members being pivotally connected to each base bar inwardly from said right and left ends;

at least two pairs of straps, at least one of each pairs of straps being an adjustable strap which is adjustable in length, each strap having a bottom end affixed to an end of each of said base bars and each of said straps having a top end held to one of said right and left elongated side tubes, whereby when each leg member has been affixed to an elongated side tube and each strap has been affixed to a base bar and to an elongated side tube, the adjustable straps may be tightened to provide a secure cot.

2. The portable cot of claim 1 wherein the straps are about vertical when the cot is assembled.

3. The portable cot of claim 2 wherein each leg member forms as angle of about 45 degrees with respect to each base bar.

4. The portable cot of claim 1 wherein each leg member is held to a side tube by being inserted into a pair of spaced holes in said side tube.

5. The portable cot of claim 1 wherein there are three pairs of leg members and three pairs of adjustable straps.

6. The portable cot of claim 1 wherein each strap is looped over an elongated side tube at its top end.

7. The portable cot of claim 1 wherein each strap is an adjustable strap.

8. The portable cot of claim 1 wherein each strap is held to an end of a base bar by a removable clip.

9. The portable cot of claim 1 wherein said base bars are fabricated from square tubing having a top surface and the leg members are pivotally held against the top surface of the leg member by a strap looped over the base of each leg member.

10. The portable cot of claim 1 wherein the right and left side tubes are split into at least two portions.

11. The portable cot of claim 10 wherein the right and left side tubes are split in half.

12. A portable cot which may be held in a disassembled condition in a compact package but which is assembled into a firm sleeping surface, said cot comprising:

a generally rectangular canvas surface member having right and left sides and having right and left elongated pockets along said right and left sides, said elongated pockets having three openings, one near each end and one at the middle and said right and left elongated pockets each having hollow right and left elongated side rails respectively, each of said right and left side rails having a pair of matching holes located in each of said openings in said elongated pockets of said canvas surface;

three sets of leg assemblies, each leg assembly having a base bar having a right and left end and each base bar having a pair of leg members fabricated from a generally "U"-shaped length of wire having a base pivotally affixed to the base bar inwardly from the right and left ends thereof and each leg member having a pair of upper termini which are inserted into said pair of matching holes in said elongated side rails; and three pairs of adjustable straps, each strap having a lower end and an upper end and each strap having means for adjusting the length thereof, each strap being affixed at its lower end to an end of a base bar and at the upper end to one of said right and left elongated rails, one strap being held between each pair of matching holes and said straps being tightened to form a secure cot.

* * * * *